US006241580B1

(12) United States Patent
Fisher

(10) Patent No.: US 6,241,580 B1
(45) Date of Patent: Jun. 5, 2001

(54) POLISH APPLYING AND BUFFING MITT, KIT AND METHOD

(76) Inventor: Kurt W. Fisher, 5419 Rutherford Way, Dayton, MD (US) 21036

( * ) Notice: Subject to any disclaimer, the term of this patent is extended or adjusted under 35 U.S.C. 154(b) by 0 days.

(21) Appl. No.: 09/421,375

(22) Filed: Oct. 20, 1999

(51) Int. Cl.[7] ..... B24B 7/30

(52) U.S. Cl. ..... 451/28; 451/533; 15/104.94; 15/227; 401/137; 401/139

(58) Field of Search ..... 15/227, 104.94; 401/137, 139, 196, 6, 7; 451/28, 533

(56) References Cited

U.S. PATENT DOCUMENTS

| | | | | |
|---|---|---|---|---|
| 660,886 | | 10/1900 | Bryan . | |
| 981,192 | | 1/1911 | Hollingshead . | |
| 1,940,728 | | 12/1933 | O'Connor . | |
| 2,351,407 | | 6/1944 | David . | |
| 2,888,133 | | 5/1959 | Betteridge . | |
| 3,056,154 | * | 10/1962 | Neal | 15/104 |
| 3,217,353 | | 11/1965 | Karcher . | |
| 3,635,567 | * | 1/1972 | Richardson, Jr. | 401/132 |
| 3,732,652 | * | 5/1973 | Furgal et al. | 451/533 |
| 3,777,328 | | 12/1973 | Kaplan . | |
| 3,806,260 | * | 4/1974 | Miller | 401/7 |
| 4,510,640 | * | 4/1985 | Omori | 15/104 |
| 4,596,481 | | 6/1986 | Tanaka . | |
| 4,788,733 | * | 12/1988 | Lerner | 15/104.94 |
| 5,010,617 | | 4/1991 | Nelson . | |
| 5,134,809 | * | 8/1992 | Morton et al. | 451/533 |
| 5,558,874 | * | 9/1996 | Harber et al. | 424/402 |
| 5,956,770 | * | 9/1999 | Dennis | 2/160 |
| 6,016,571 | * | 1/2000 | Guzman et al. | 2/167 |
| 6,018,837 | * | 2/2000 | Andreu | 15/118 |
| 6,145,155 | * | 11/2000 | James et al. | 15/227 |

FOREIGN PATENT DOCUMENTS

| | | |
|---|---|---|
| 261274 | 6/1960 | (AU) . |
| 114265 | 3/1918 | (GB) . |
| 327352 | 4/1930 | (GB) . |
| 858087 | 1/1961 | (GB) . |
| 52-20155 | 2/1977 | (JP) . |

* cited by examiner

*Primary Examiner*—Joseph J. Hail, III
*Assistant Examiner*—George Nguyen
(74) *Attorney, Agent, or Firm*—Carter, Ledyard & Milburn

(57) ABSTRACT

A disposable polish applying and buffing mitt comprising a multilayered mitt with a polish impervious layer removably attached to a material pervious to polish such that the material pervious to polish would stain the hand of the user if used to apply the polish but is suitable for buffing the object to which the polish has been applied. A disposable polish applying and buffing kit comprising a multilayered mitt with a first layer of polish impervious material removably secured to a second layer of polish impervious material forming a compartment therebetween which can hold a polish. The first layer of polish impervious material is removed from the second layer of polish impervious material to expose the polish for application. After the polish is applied to the object, the second layer of polish impervious material is removed to expose the buffing mitt.

21 Claims, 2 Drawing Sheets

POLISH APPLYING AND BUFFING MITT, KIT AND METHOD

BACKGROUND

This application is directed to a disposable polish applying and buffing mitt, a disposable polish applying and buffing kit, and methods of using the mitt and kit.

The consumer market for quick disposable products that provide high quality polishing results is growing. The demand is great for a product that provides a high quality polish without the need for time consuming clean-up in a variety of environments such as shining shoes, waxing an automobile, applying plastic protectants to an automobile, polishing silverware, staining furniture, cleaning furniture, oven cleaning, medical equipment cleanup, washing windows, cleaning and conditioning leather and even for wiping and clean-up of babies.

Many products on the market today promise to instantly polish an object. However, many of these products do not actually apply a polish but rather only clean or shine the object and then do not provide a proper, long lasting polish because of the limitations on the choice of polish which result from the disposable character thereof.

Polishing mitts are well known. Typically, they utilize the same material for applying the polish and buffing and, require reversing of the mitt on the hand between the application of the polish and buffing of the polish. Often this allows polish to be absorbed into the polish application layer during the polishing step resulting in the need for a great quantity of polish and staining the hand. In addition, the polish application layer surface is exposed during buffing and often results in soiling of the hands or clothes of the person doing the polishing. Many also require cleanup after use.

Accordingly it is the object of the present invention to provide novel devices and methods which obviate many of the deficiencies of known disposable polishers.

It is another object of the present invention to provide a novel disposable polish applying and buffing mitt and a polish applying and buffing kit for use in applying a polish to an object and buffing the polish into the object.

It is still a another object of the present invention to provide a novel disposable polish applying and buffing kit that contains a polish.

It is yet a another object of the present invention to provide a novel disposable polish applying and buffing mitt and kit that includes a first layer that can be used to clean the object before the polish is applied.

It is a further object of the present invention to provide a novel disposable polish applying and buffing mitt and kit that can be used for two different applications.

It is still a further object of the present invention to provide a polish applying and buffing mitt and a novel method of applying polish to an object using the mitt.

It is yet a further object of the present invention to provide a polish applying and buffing kit and a novel method of applying polish to an object using the kit.

These and many other objects and advantages of the present invention will be readily apparent to one skilled in the art to which the invention pertains from a perusal of the claims, the appended drawings, and the following detailed description of the preferred embodiments.

DESCRIPTION OF THE PREFERRED EMBODIMENTS

Figure 1:
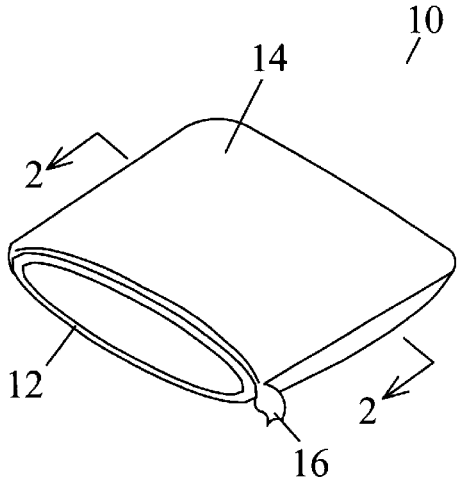
FIG. 1 is pictorial view of a hand sized embodiment of the mitt of the present invention with a polish impervious layer on one side.
Figure 2:
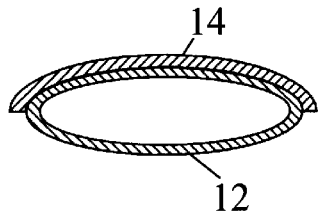
FIG. 2 is a section taken through lines 2—2 of FIG. 1.

With reference to FIG. 1 and FIG. 2, one embodiment of the disposable polish applying and buffing mitt 10 of the present invention is dimensioned and configured to receive a human hand. The polish applying and buffing mitt can also be dimensioned and configured to receive one, two, three, or four fingers; or have a thumb sleeve; or be gloved shaped. The configuration and dimension of the buffing mitt is desirably selected based on the object to be polished. For example, to apply a car wax a large mitt would be preferred, while to polish smaller objects like silverware, a one-finger or two-finger shaped mitt would be preferred.

The polish applying and buffing mitt 10 is a multilayered mitt that comprises a buffing mitt 12 of a material pervious to the polish to be applied to the object suitable for buffing. The material pervious to the polish may be any material suitable for buffing the object to be polished, e.g., cotton, cotton flannel, fabric, terry cloth, chamois, or paper product. The mitt 10 further comprises a layer of material 14 impervious to the polish that is removably secured to the buffing mitt 12 on one side of the polish applying and buffing mitt 10. The layer 14 may be any material suitable for applying polish to the object, e.g., plastic or polymer film. The size of the polish impervious layer on the buffing mitt is dependent on the object to be polished. For example, to apply wax to a car the polish impervious layer may cover at least one side of the mitt, while for shining a shoe the polish impervious layer may cover approximately one third of the closed end of the mitt one side thereof.

The polish impervious layer 14 is removably secured to the buffing mitt 12 such that the layer 14 can be removed from the buffing mitt 12 once the polish has been applied to the object. In the present embodiment a tab 16, attached to the layer 14, is pulled to remove the layer 14 from the buffing mitt 12. The layers of the mitt and kit can be removably secured to each other by any suitable means, e.g., the layer is removably secured to the buffing mitt by plastic perforation that can be released by pulling a tab attached to the layer; a tab attached to the layer that comprises a plastic sealing ring can be pulled to remove the layer from the buffing mitt; or a tab attached to the layer can be pulled to remove the layer from the buffing mitt by breaking the seal between the layer and the buffing mitt. The seal between the layer and the buffing mitt may be any conventional seal such as a heat seal or pressure sensitive seal.

The mitt 10 is dimensioned and configured to receive a human hand into the open pocket of the buffing mitt and may be dipped into a polish so that the polish impervious layer 14 receives the polish and the layer 14 is used to apply the polish to the object by the hand within the buffing mitt 10. After the proper amount of polish has been applied to the object the layer 14 can be removed exposing the buffing mitt 12. The layer 14 can be removed from the buffing mitt 12 by pulling the tab 16 attached to the layer 14. The buffing mitt 12 can then be used to buff the polish into the object by the hand within said buffing mitt. When the buffing is completed the buffing mitt 12 can be removed from the hand for disposal.

In another embodiment of the disposable polish applying and buffing mitt, separate polish impervious layers may be removably secured on opposite sides of the buffing mitt to the buffing mitt such that the buffing mitt can be used on two separate occasions for application of polish.

Figure 3:
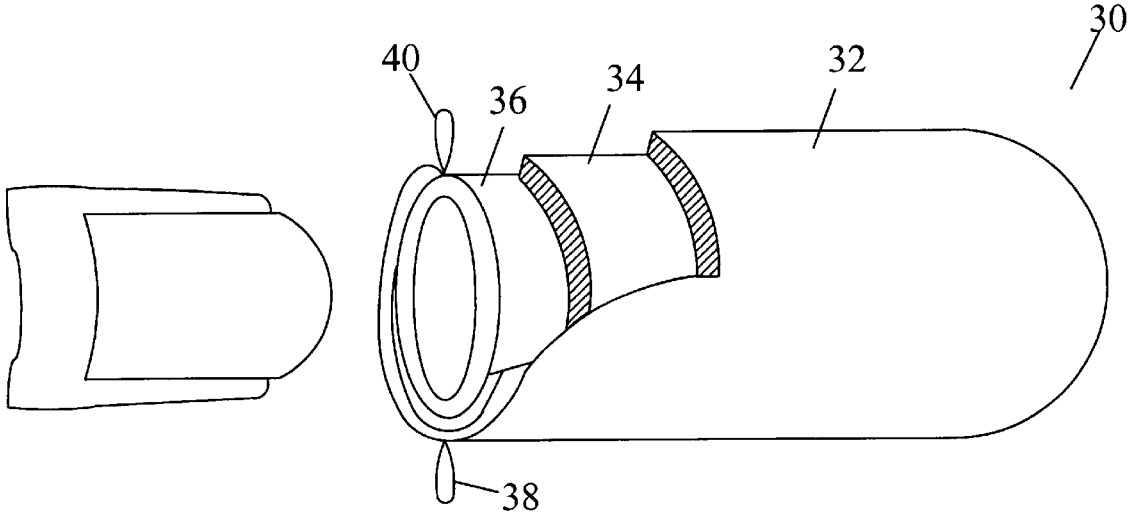
FIG. 3 is a pictorial view of a finger shaped embodiment of the mitt of the present invention in a partial section illustrating cleaning, polish applying, and buffing layers.

With reference to FIG. 3, polish applying and buffing mitt 30 is dimensioned and configured to receive a finger and to include a layer of cleaning material 32 removably secured to the polish impervious layer 34. The cleaning material layer can be comprised of any material suitable for the cleaning of the object to be polished, e.g., cotton, cotton flannel, fabric, terry cloth, or paper product. Pulling the tab 38 attached to the cleaning layer 32 removes the cleaning layer 32 from the polish impervious layer 34. The layer 34 is removably secured to the buffing mitt 36 by a tab 40 which is attached to the layer 34 thereof such that pulling the tab 40 removes the polish impervious layer 34 from said buffing mitt 36 as described in connection with the mitt of FIG. 1.

A finger can be inserted into the open end of the mitt 30 and the cleaning layer 32 may be used to clean the object to be polished. When the object has been cleaned, the cleaning layer 32 can be removed by pulling the tab 38 attached to the cleaning layer 32 which removes the cleaning layer 32 from the polish impervious layer 34. The layer 34 may then be dipped into a polish so that the layer 34 is used to apply the polish to the object by the finger within the buffing mitt 36. After the proper amount of polish has been applied to the object, the layer 34 can be removed from the buffing mitt 36 by pulling on the tab 40 attached to layer 34 to remove the layer 34 and expose the buffing mitt 36. The mitt 36 can then be used to buff the polish into the object by the finger within said buffing mitt 36. After the buffing of the object is completed, the finger shaped buffing mitt 36 can be removed for disposal.

Figure 4:
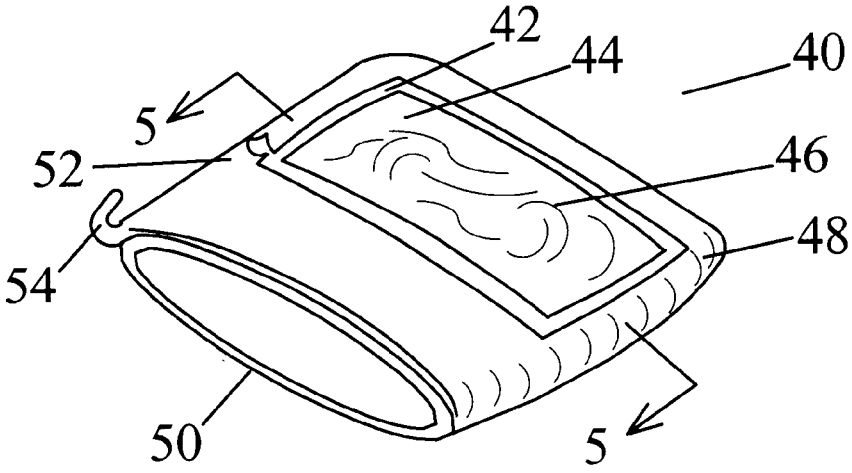
FIG. 4 is a pictorial view of a first embodiment of a hand sized kit illustrating a polish containing compartment adjacent the distal end thereof.
Figure 5:
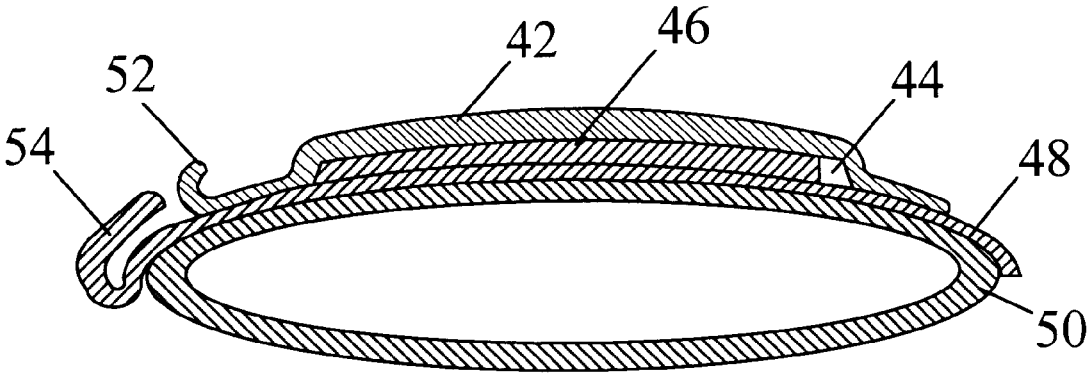
FIG. 5 is a section taken through lines 5—5 of FIG. 4.

With reference now to FIG. 4 and FIG. 5, a disposable polish applying and buffing kit 40 is dimensioned and configured to receive a human hand which is inserted into the open pocket of the kit 40. The kit 40 has a first layer of material 42 impervious to the polish to be applied to the object. The first layer 42 is removably secured to a second layer of material 48 impervious to the polish and forms a sealed compartment 44 between said first and second layers. The sealed compartment 44 contains a quantity of polish 46 sufficient to cover the object to be polished. The polish can be any material suitable for polishing an object, e.g., shoe polish, car wax, furniture wax, silver polish, plastic and vinyl protectants, leather cleaner, window cleaner and other general types of cleaners (e.g., solvents, degreasers, disinfectants, and soaps).

The first layer 42 is removably secured to the second layer 48 and can be removed from the second layer to expose the polish 46 by pulling the tab 52 attached to the first layer 42. The second layer 48 is removably secured to the buffing mitt 50 and can be removed from the buffing mitt 50 by pulling the tab 46 attached to the second layer 48.

The polish applying and buffing kit 40 can be used by placing a hand inside the open end of the kit 40. The first layer 42 is removed from the second layer 48 by pulling tab 52 which removes the first layer 42 and exposes the polish 46. The layer 48 is then used to apply the polish 46 to the object by the hand within the buffing mitt 50. When the proper amount of polish 46 has been applied to the object to be polished the second layer 48 can be removed from the buffing mitt 50 by pulling tab 54 attached to the second layer 48. Pulling tab 54 removes the second layer 48 from the kit 40 and exposes the buffing mitt 50. The buffing mitt 50 can then be used to buff the polish 46 into the object by the hand within the buffing mitt 50. After buffing of the object is completed, the buffing mitt 50 can be removed for disposal.

In another embodiment of the polish applying and buffing kit, a layer of cleaning material can be removably secured to the first layer of polish impervious material so that the layer of cleaning material can be used to clean the object to be polished prior to applying a polish. The cleaning layer is removably secured to the first layer and is removed from the kit after the object has been cleaned by pulling a tab attached to the cleaning layer.

In yet another embodiment, the disposable polish applying and buffing kit has separate first layers, polish, and second layers on opposite sides of the buffing kit to allow for the kit to be used twice. The first and second layers are removably secured such that they are separately removed from one side of the kit.

In a further embodiment, the disposable polish applying and buffing kit is comprises a glove-shaped buffing mitt that is maintained in the shape of a mitt by the second polish impervious layer. When the second layer is removed from the buffing mitt, the buffing mitt can be formed into a glove shape by moving the fingers with the glove shaped buffing mitt. This embodiment is effective for polishing objects that have smaller pockets into which the polish needs to be buffed such as finely crafted furniture with embossed ornamentations on the surface thereof.

ADVANTAGES AND SCOPE OF THE INVENTION

The advantages of the present inventions are numerous. The polish applying and buffing mitt and the polish applying and buffing kit can be designed to optimize the polishing of an object by selecting a polish impervious layer and pervious material for the buffing mitt based on the object to be polished and the polish to be used. The same object can require different polish operations. For example, a boot could require a design to apply shoe polish and another design to apply water proofing material.

The use of a polish impervious material in the design allows for less polish required for the polish applying step. Since less polish is required in the design, manufacturing costs will be reduced without a decrease in polishing results.

The polish applying and buffing mitt and the polish applying and buffing kit can be dimensioned and configured to ensure the object is polished correctly. Basing the configuration of the mitt and kit on the object to be polished will ensure a higher quality polish. The mitt and kit can be shaped to receive a hand, have a thumb sleeve in the mitt, receive one to four fingers, be round or square. However the possible configurations of the mitt and kit are not based on size and shape alone. Additional features can be added to the mitt and kit to optimize the polishing of an object. An outer cleaning layer can be added to the mitt or kit. For example the cleaning layer may comprise an absorbent material. An additional buffing strap can be included inside the mitt or kit. In some cases two buffing layers removably secured to each other will be required to properly polish the object. The two buffing layers can even be made of different materials resulting in a higher quality polish than just one buffing layer. The same holds true for the polish impervious layers where in some cases two layers may be needed to apply the polish to the object with a first specific layer of polish impervious material and a second polish impervious layer to further aid the application of the polish prior to buffing.

The polish applying and buffing mitt is suitable for any operation that benefits from the application of a polish to an object by a polish impervious layer and buffing of the polish into the object by a pervious layer, including wiping, washing, cleaning or dusting of an object. Such operations include but are not limited to cleaning and polishing mechanical equipment. The cleaning layer may be used to remove substances such as excess grease from mechanical equipment. After cleaning, the cleaning layer may be removed and the polish impervious layer may be used to apply degreaser to the equipment. After application of the degreaser, the polish impervious layer may be removed and the pervious material of the buffing mitt may then be used to buff the degreaser into the equipment. When buffing is completed the buffing mitt can be removed for disposal. The result is clean equipment without the soiling of the hands.

Further by way of example, the polish applying and buffing mitt may be useful in the cleanup of medical equipment if utilized with hospital gloves. The cleaning layer may be used to wipe the medical wastes from medical equipment, such as an operating table. After cleaning, the cleaning layer may be removed and the polish impervious layer may further wipe any excess medical wastes from the table if required, and then may be used to apply a disinfectant or cleaner to the medical equipment. After application of the disinfectant or cleaner the polish impervious layer may be removed and the pervious material of the buffing mitt may then be used to buff the disinfectant or cleaner into the equipment. When the buffing is completed the buffing mitt may be removed for disposal. The use of medical gloves in conjunction with the polish applying and buffing mitt would protect the user from the medical wastes.

The polish applying and buffing mitt and the polish applying and buffing kit allow for the consumer to polish an object without requiring cleanup. There is no need to reverse orient the mitt on the consumer's hand while polishing an object which could result in soiling of the hand or fingers. The removable layers are designed so that the consumer will never come in contact with the polish. Often the polish impervious layer is removed after the polish is applied so that there is not an exposed layer of polish during buffing. This cleanup free feature lends itself to travelers or to consumers in a hurry to complete the polishing of an object.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A disposable polish applying and buffing mitt comprising:

a buffing mitt dimensioned and configured to receive at least a portion of a human hand, said buffing mitt being made of material pervious to a polish to be applied to an object to be buffed so that the use of the buffing mitt for the application of the polish would be likely to stain the portion of the hand within said buffing mitt during the application of the polish, and said material being suitable for buffing the object once the polish has been applied to the object;

a layer of material impervious to the polish to be applied to the object, said layer removably secured to said buffing mitt on at least one side thereof in a position with respect to said buffing mitt for the application of the polish to the object to be buffed by the portion of the hand within said buffing mitt, said layer being manually removable from said buffing mitt after the mitt has been used to apply polish to the object so that the object may be buffed by the portion of the hand within said buffing mitt.

2. The polish applying and buffing mitt of claim 1 wherein the material of said polish impervious layer is selected from the group consisting of plastic and polymer film.

3. The polish applying and buffing mitt of claim 1 wherein said polish impervious layer covers approximately one third of the closed end of said buffing mitt on one side thereof.

4. The polish applying and buffing mitt of claim 1 wherein both sides of said buffing mitt comprise a polish impervious layer removably secured to said buffing mitt such that said buffing mitt can be used for two applications of polish.

5. The polish applying and buffing mitt of claim 1 further comprising a layer of cleaning material removably secured to said polish impervious layer on the side thereof opposite to said buffing mitt in a position for cleaning the object to be buffed by hand within said buffing mitt, said cleaning layer being manually removable from said polish impervious layer after said cleaning layer has been used to clean the object so that said polish impervious layer can be used to apply the polish.

6. The polish applying and buffing mitt of claim 5 wherein the material of said cleaning layer is selected from the group consisting of wool, cotton, fabric, terry cloth and paper product.

7. The polish applying and buffing mitt of claim 1 wherein said buffing mitt is configured to receive a human hand.

8. The polish applying and buffing mitt of claim 7 wherein said buffing mitt includes a thumb sleeve.

9. The polish applying and buffing mitt of claim 1 wherein said buffing mitt is configured to receive at least one human finger.

10. The polish applying and buffing mitt of claim 1 wherein the pervious material of said buffing mitt is selected from the group consisting of cotton, cotton flannel, fabric, terry cloth, chamois and paper product.

11. The polish applying and buffing mitt of claim 1 further comprising a buffing strap carried by said buffing mitt internally thereof adjacent to the open end thereof.

12. The polish applying and buffing mitt of claim 1 further comprising:

a second layer of material impervious to the polish to be applied to the object;

said second layer being removably secured to said layer in a position with respect to said second layer to form a sealed compartment therebetween; and, a quantity of polish sufficient to cover the surface of the object to be polished, said polish found contained within said compartment between said layer and said second layer;

said second layer being manually removable from said layer to expose said polish for application to the object.

13. A disposable polishing kit comprising:

a buffing mitt made of material pervious to a polish to be applied to an object to be buffed so that the use of the buffing mitt for the application of the polish would be likely to stain the hand within said buffing mitt during the application of the polish, and said material being suitable for buffing the object once the polish has been applied to the object;

a first layer of material impervious to the polish to be applied to the object, said first layer removably secured to said buffing mitt on at least one side thereof in a position with respect to said buffing mitt for the application of the polish to the object to be buffed by the hand within said buffing mitt, said layer being manually removable from said buffing mitt after the mitt has been used to apply polish to the object so that the object may be buffed by the hand within said buffing mitt;

a second layer of material impervious to the polish to be applied to the object;

said second layer being removably secured to said first layer in a position with respect to said second layer to form a sealed compartment therebetween; and, a quantity of polish sufficient to cover the surface of the object to be polished, said polish found contained within said compartment between said first and second layers;

said second layer being manually removable from said first layer to expose said polish for application to the object.

14. The polishing kit of claim 13 wherein the pervious material of said buffing mitt is selected from the group consisting of cotton, cotton flannel, fabric, terry cloth, chamois and paper product.

15. The polishing kit of claim 13 wherein said buffing mitt is dimensioned and configured to receive a human hand.

16. The polishing kit of claim 13 wherein said buffing mitt dimensioned and configured to receive at least one human finger.

17. The polishing kit of claim 13 further comprising a buffing strap carried by said buffing mitt internally thereof adjacent to the open end thereof.

18. The polishing kit of claim 13 wherein said first and second layers form a compartment on both sides of said buffing mitt; wherein each layer is removably secured such that said buffing mitt can be used for two applications of polish.

19. The polishing kit of claim 13 wherein said second layer has sufficient strength to hold together said buffing mitt in a mitt shape when said buffing mitt further comprises a gloved shaped inner buffing mitt;

such that after said second layer of material is removed from said buffing mitt, said buffing mitt can then be spread out by the fingers within said buffing mitt such that a glove is formed which can be used to buff the polish into the object.

20. A method of polishing an object comprising the steps of:

(a) providing a multilayered mitt with a thumb sleeve suitable to receive the human hand;

(b) applying a polish to an object using the outer layer of polish imprevious material of the mitt;

(c) removing the outer polish impervious layer from the mitt to expose a layer of buffing material;

(d) buffing the polish applied to the object with the layer of buffing material; and, (e) removing the mitt from the hand for disposition.

21. A method of polishing an object comprising the steps of:

(a) providing a polishing kit suitable to receive the human hand;

(b) removing the first layer of polish impervious material to expose a polish attached to the second layer of polish impervious material;

(c) applying the polish to an object using the second layer of polish impervious layer of the mitt;

(d) removing the second polish impervious layer from the mitt to expose a layer of buffing material;

(e) buffing the polish applied to the object with the layer of buffing material; and, (f) removing the mitt from the hand for disposition.

* * * * *